US009310723B2

(12) United States Patent
Hatazaki

(10) Patent No.: US 9,310,723 B2
(45) Date of Patent: Apr. 12, 2016

(54) IMAGE HEATING APPARATUS MOVING MECHANISM CONFIGURED TO MOVE URGING ROLLER CONFIGURED TO URGE CLEANING WEB TOWARD ROTATABLE COLLECTING MEMBER

(71) Applicant: CANON KABUSHIKI KAISHA, Tokyo (JP)

(72) Inventor: Kazunari Hatazaki, Nagareyama (JP)

(73) Assignee: Canon Kabushiki Kaisha, Toyko (JP)

( * ) Notice: Subject to any disclaimer, the term of this patent is extended or adjusted under 35 U.S.C. 154(b) by 0 days.

(21) Appl. No.: 14/632,330

(22) Filed: Feb. 26, 2015

(65) Prior Publication Data

US 2015/0253700 A1 Sep. 10, 2015

(30) Foreign Application Priority Data

Mar. 10, 2014 (JP) ..... 2014-045861

(51) Int. Cl.
*G03G 15/20* (2006.01)

(52) U.S. Cl.
CPC ..... *G03G 15/2025* (2013.01); *G03G 15/2039* (2013.01)

(58) Field of Classification Search
CPC ..... G03G 15/2025; G03G 15/2039
USPC ..... 399/327
See application file for complete search history.

(56) References Cited

U.S. PATENT DOCUMENTS 8,897,666 B2 * 11/2014 Sugino ..... G03G 15/2025 399/327
8,929,794 B2 1/2015 Hatazaki
8,977,176 B2 * 3/2015 Shimizu ..... G03G 15/5025 399/327
2014/0270866 A1 9/2014 Hatazaki
2014/0270867 A1 9/2014 Hatazaki
2014/0270868 A1 9/2014 Chioyda et al.
2014/0369728 A1 12/2014 Hatazaki

FOREIGN PATENT DOCUMENTS

JP 6-194986 7/1994
JP 2004-212409 7/2004

OTHER PUBLICATIONS

U.S. Appl. No. 14/640,284, filed Mar. 6, 2015.

* cited by examiner

*Primary Examiner* — William J Royer
(74) *Attorney, Agent, or Firm* — Fitzpatrick, Cella, Harper & Scinto

(57) ABSTRACT

An image heating apparatus includes: a heating member; a collecting member; a cleaning web; an urging roller; a moving mechanism configured to move the urging roller between a first position where the cleaning web contacts the collecting member, a second position where the cleaning web contacts the collecting member at a contact pressure lower than a contact pressure at the first position, and a third position where the cleaning web is spaced from the collecting member; an executing portion configured to execute a collecting member cleaning operation at the second position and the first position in this order; and a controller configured to control a temperature of the collecting roller so that the temperature when the urging roller is moved from the third position to the second position is higher than the temperature when the urging roller is moved from the second position to the first position.

19 Claims, 7 Drawing Sheets

IMAGE HEATING APPARATUS MOVING MECHANISM CONFIGURED TO MOVE URGING ROLLER CONFIGURED TO URGE CLEANING WEB TOWARD ROTATABLE COLLECTING MEMBER

FIELD OF THE INVENTION AND RELATED ART

The present invention relates to an image heating apparatus. This image heating apparatus is used in an image forming apparatus such as a copying machine, a printer, a facsimile machine and a multi-function machine having a plurality of functions of these machines.

In a conventional image forming apparatus of an electrophotographic type, a toner image formed on a recording material is fixed by a fixing device (image heating apparatus).

In such a fixing device, e.g., in the case where a jam is generated, there is a risk that a large amount of toner is offset on a fixing roller (rotatable heating member), and therefore a mechanism for cleaning the fixing roller is provided (Japanese Laid-Open Patent Application (JP-A) Hei 6-194986). Specifically, a constitution in which the fixing roller is cleaned using a cleaning web is employed.

Further, there is a risk that the fixing roller is damaged by a foreign matter sandwiched between the fixing roller and the web, and therefore a constitution in which a collecting roller is interposed between the fixing roller and the web has been proposed (JP-A 2004-212409). Specifically, a device is employed in which the offset toner is once collected from the fixing roller onto the collecting roller, and then the collected offset toner is cleaned with the web.

However, in the case where a large amount of the toner is offset on the fixing roller with the generation of the jam, in order to resume image formation soon thereafter, the large amount of offset toner is required to be removed in a short time.

SUMMARY OF THE INVENTION

According to an aspect of the present invention, there is provided an image heating apparatus comprising: a rotatable heating member configured to heat a toner image on a recording material; a rotatable collecting member configured to collect a toner deposited on the rotatable heating member; a cleaning web configured to clean the rotatable collecting member; an urging roller configured to urge the cleaning web toward the rotatable collecting member; a moving mechanism configured to move the urging roller so as to be movable between a first position where the cleaning web contacts the rotatable collecting member, a second position where the cleaning web contacts the rotatable collecting member at a contact pressure lower than the contact pressure at the first position, and a third position where the cleaning web is spaced from the rotatable collecting member; an executing portion configured to execute an operation in a cleaning mode in which the rotatable collecting member is cleaned at the second position and the first position in this order; and a controller configured to control the temperature of the rotatable collecting roller so that the temperature when the urging roller is moved from the third position to the second position is higher than the temperature when the urging roller is moved from the second position to the first position.

According to another aspect of the present invention, there is provided an image heating apparatus comprising: a rotatable heating member configured to heat a toner image on a recording material; a rotatable collecting member configured to collect a toner deposited on the rotatable heating member; a cleaning web configured to clean the rotatable collecting member; an urging roller configured to urge the cleaning web toward the rotatable collecting member; a moving mechanism configured to move the urging roller so as to be movable between a first position where the cleaning web contacts the rotatable collecting member, a second position where the cleaning web contacts the rotatable collecting member at a contact pressure lower than the contact pressure at the first position, and a third position where the cleaning web is spaced from the rotatable collecting member; an executing portion configured to execute an operation in a cleaning mode in which the rotatable collecting member is cleaned at the second position and the first position in this order; and a controller configured to control the temperature of the rotatable collecting roller in the operation in the cleaning mode, wherein in the operation in the cleaning mode, the moving mechanism moves the urging roller from the third position to the second position when the temperature is a first temperature, and moves the urging roller from the second position to the first position when the temperature is a second temperature lower than the first temperature.

According to a further aspect of the present invention, there is provided an image heating apparatus comprising: a rotatable heating member configured to heat a toner image on a recording material; a rotatable collecting member configured to collect a toner deposited on the rotatable heating member; a cleaning web configured to clean the rotatable collecting member; an urging roller configured to urge the cleaning web toward the rotatable collecting member; a moving mechanism configured to move the urging roller so as to be movable between a first position where the cleaning web contacts the rotatable collecting member, a second position where the cleaning web contacts the rotatable collecting member at a contact pressure lower than the contact pressure at the first position, and a third position where the cleaning web is spaced from the rotatable collecting member; an executing portion configured to execute an operation in a cleaning mode in which the rotatable collecting member is cleaned at the second position and the first position in this order; and a controller configured to move the cleaning web from the first position to the third position with the generation of a jam and configured to start a cleaning process after jam clearance by moving the cleaning web from the third position to the second position when the temperature of the rotatable collecting member is not less than a predetermined temperature.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described with reference to the drawings. In the following embodiments, a constitution in which an image heating apparatus is used as a fixing device for fixing an unfixed toner image on a sheet (recording material) will be described, but the present invention can also be carried out as a heat treatment device for adjusting an image surface property by heating the recording material on which a fixed image or a partly fixed image is carried.

Incidentally, dimensions, materials and shapes of constituent elements and their relative arrangements and the like described in the following embodiments should be changed appropriately depending on structures and various conditions of apparatuses (devices) to which the present invention is applied, and the present invention is not intended to be limited to the following embodiments.

Figure 1:
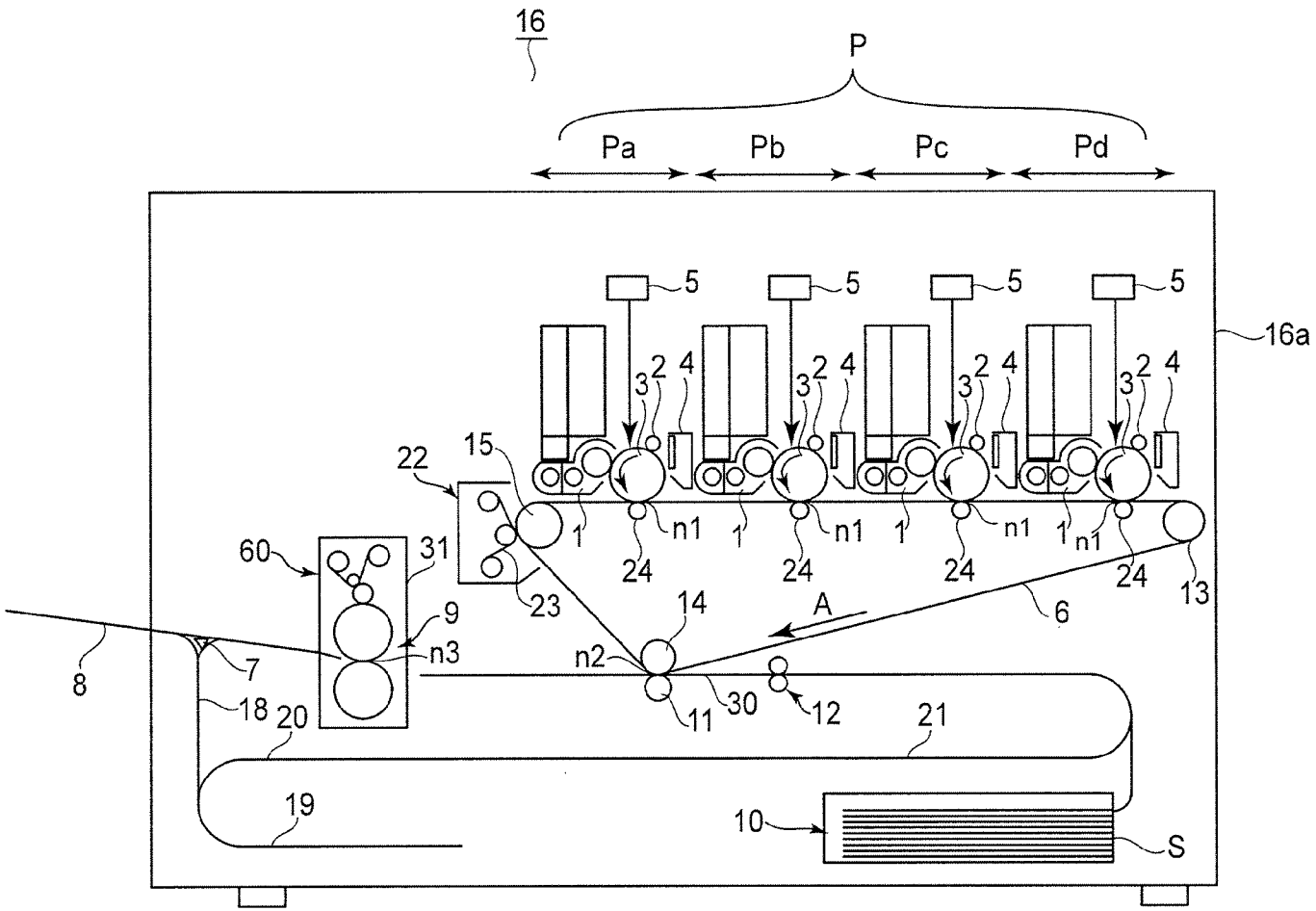
FIG. 1 is a schematic sectional view of an image forming apparatus.

First, a color electrophotographic printer as an image forming apparatus according to the present invention will be described with reference to FIG. 1. FIG. 1 shows a cross-section of the color electrophotographic printer along a feeding direction of a sheet. In the following embodiments, the color electrophotographic printer is simply referred to as a printer.

As shown in Embodiment 1, a printer 16 includes a printer main assembly 16*a* provided with image forming portions Pa, Pb, Pc and Pd corresponding to colors of Y (yellow), M (magenta), C (cyan) and Bk (black), respectively. The image forming portions Pa, Pb, Pc and Pd are different in the colors of toners used, which are Y, M, C and Bk, respectively, but the same structure is employed. For this reason, these image forming portions will be described as a common image forming portion P.

The image forming portion P includes an electrophotographic photosensitive drum 3 and members, including a charger 2, a laser scanner 5, a developing device 1, a primary transfer roller 24 and a drum cleaner 4, which are provided in the listed order along a rotational direction of the photosensitive drum 3.

In each image forming portion P, the photosensitive drum 3 is electrically charged by the charger 2 in advance, and thereafter an electrostatic latent image is formed by the laser scanner 5. In the laser scanner 5, an unshown light source device and a polygon mirror are provided. Laser light emitted from the light source device is used to scan the surface of the photosensitive drum 3 with the polygon mirror, and light fluxes of the scanning light are deflected by a reflection mirror and are focused on a generatrix of the photosensitive drum 3 by an unshown fθ lens to expose the photosensitive drum surface, so that the electrostatic latent image depending on an image signal is formed on the photosensitive drum 3.

Then, the electrostatic latent image is visualized as a toner image by the developing device 1. That is, in the developing device 1, as a developer, a toner of a corresponding color is filled in a predetermined amount by an unshown supplying device. Each developing device 1 develops the electrostatic latent image on the corresponding photosensitive drum 3, and thus visualizes the electrostatic latent image as the toner image of the corresponding color.

The toner used in this embodiment contains (incorporates), a wax consisting of paraffin or polyolefin, or a silicone oil as a parting agent. Specifically, in this embodiment, a toner obtained by finely dispersing a wax component and a pigment into a pulverized toner is used. A constitution in which a polymerization toner containing such a wax component is used may also be employed. In the following description, as the parting agent, the wax is described as an example, but as described above, also the case where the silicone oil is used as the parting agent is similarly applied.

The toner images, corresponding to the associated colors, formed on the respective photosensitive drums 3 are successively primary-transferred onto an intermediary transfer belt 6 as an image bearing member by primary transfer rollers 24. That is, in a process in which the toner image formed and carried on the associated photosensitive drum 3 passes through a primary transfer nip n1 between the photosensitive drum 3 and the intermediary transfer belt 6, the toner image is intermediately transferred onto an outer peripheral surface of the intermediary transfer belt 6 by pressure and an electric field formed by a primary transfer bias applied to the intermediary transfer belt 6. After this primary transfer, a transfer residual toner remaining on the photosensitive drum 3 is removed by cleaning with the drum cleaner 4, and therefore the surface of the photosensitive drum 3 is cleaned and can prepare for subsequent image formation.

On the other hand, a recording material S is fed one by one from a sheet feeding cassette 10 and then is sent into a registration roller pair 12. The registration roller pair 12 once receives the recording material S and corrects oblique movement of the recording material S. Then, the registration roller pair 12 sends the recording material to a secondary transfer nip n2 between the intermediary transfer belt 6 and a secondary transfer roller 11 in synchronism with the toner image on the intermediary transfer belt 6. The intermediary transfer belt 6 is constituted so that the intermediary transfer belt 6 is rotatable at the same peripheral speed as those of the photosensitive drums 3 in an arrow A direction by stretching rollers 13, 14 and 15.

The color toner images on the intermediary transfer belt 6 are secondary-transferred onto the recording material S at the secondary transfer nip n2 by the secondary transfer roller 11. The secondary transfer roller 11 is shaft-supported in parallel with the intermediary transfer belt 6 correspondingly to the intermediary transfer belt 6, and is supported in a state in which the secondary transfer roller 11 contacts a lower surface of the intermediary transfer belt 6. To the secondary transfer roller 11, a desired secondary transfer bias is applied by a secondary transfer bias (voltage) source (not shown). The secondary transfer, onto the recording material S, of the four color toner images superposedly transferred as a synthetic color toner image is carried out in the following manner. That is, the recording material S fed from the sheet feeding cassette 10 passes through the registration roller pair 12 and a pre-transfer guide 30 and then is fed to the secondary transfer nip n2 at a predetermined timing, and at the same time, the secondary transfer bias is applied from the bias (power) source to the secondary transfer roller 11, whereby the secondary transfer is carried out.

By this secondary transfer bias, the synthetic color toner image is secondary-transferred from the intermediary transfer belt 6 onto the recording material S. The synthetic color toner image is formed on the recording material S while leaving a certain margin from each of four edges of the recording material S. In this embodiment, the leading end portion margin is about 2-3 mm. A transfer residual toner and other foreign matter are wiped off by rubbing the surface of the intermediary transfer belt 6 with a cleaning web 23 consisting of a nonwoven fabric in a belt cleaner 22.

Then, the recording material S on which the toner images are secondary-transferred is introduced successively into a heating nip n3 of a fixing device 9, so that the toner images on the recording material (sheet) S are fixed by being heated and pressed at the heating nip n3. As a specific example of the recording material S on which the toner image is to be formed, it is possible to use plain paper, a resin-made sheet material as an alternative to the plain paper, thick paper, a recording material for an overhead projector, and the like.

In the case where the toner image is formed on one surface of the recording material S, depending on a condition, a feeding path is switched by a switching member (flapper) 7. On the other hand, in the case where the toner image is formed on double (both) surfaces of the recording material S, the recording material S on which the toner image is fixed by the fixing device 9 is guided onto a discharge tray 8 by the switched switching member 7. Then, when a trailing end of the recording material S reaches a reversing point, the recording material S is fed along switch-back feeding paths 18, 19 and 20 in a switch-back manner, and is turned upside down. Thereafter, the recording material S is fed along a feeding path 21 for double-side printing, and then is subjected to the same process as that during one-side image formation (printing), so that the toner image is formed on the other (back) surface, and then is discharged on the discharge tray 8.

Incidentally, in the case of a printer having a monochromatic (Bk single color) structure, only the photosensitive drum 3 for black in the above-described exists, and the toner image formed on the photosensitive drum 3 is constituted so as to be transferred onto the recording material by a transfer device.

The fixing device 9 in this embodiment has a constitution in which the toner image formed on the recording material S by using the toner containing the parting agent is fixed on the recording material S by being heated and pressed. The constitution will be specifically described.

[Fixing Device]

Figure 2:
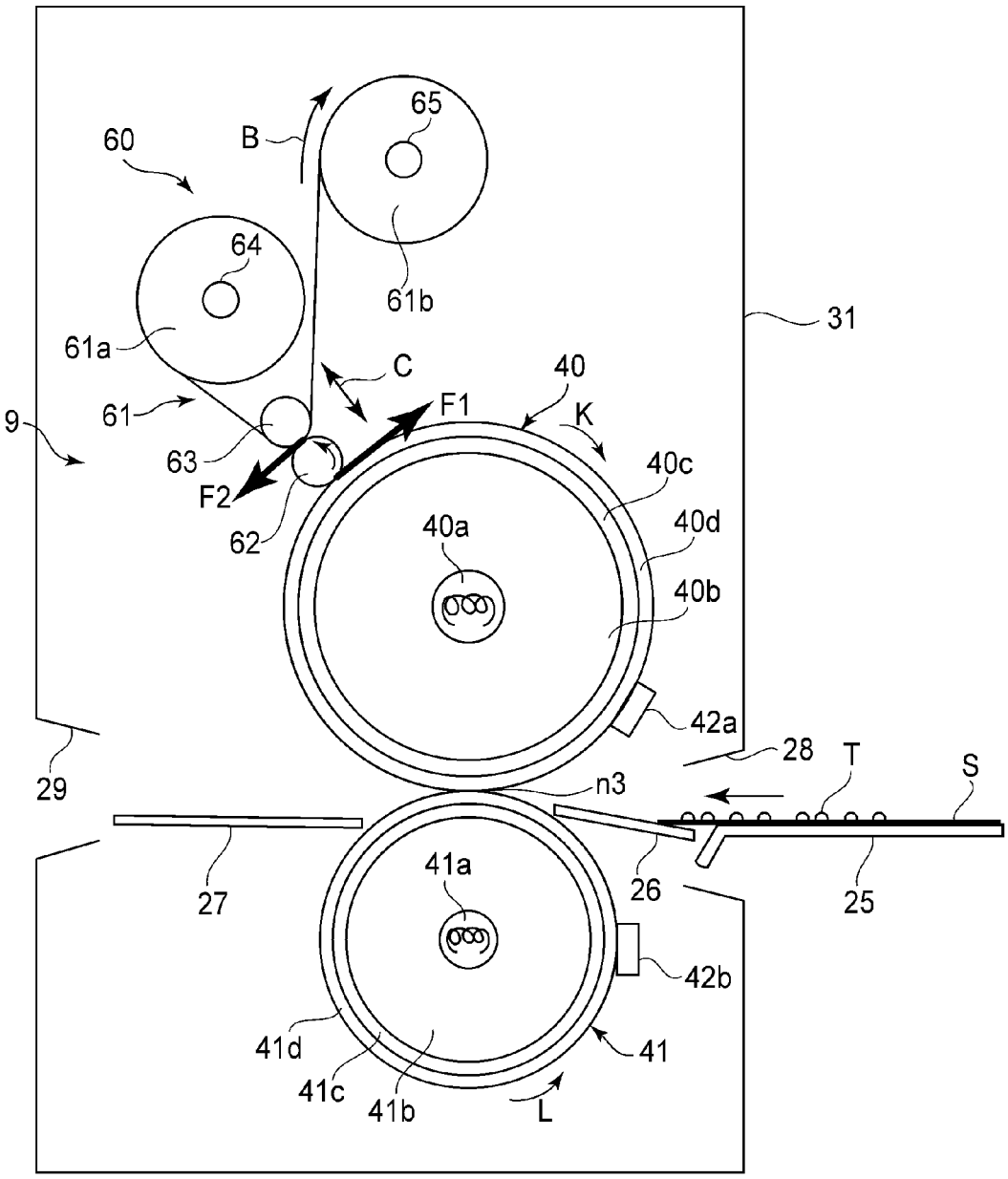
FIG. 2 is a sectional view showing a structure of a fixing device.
Figure 3:
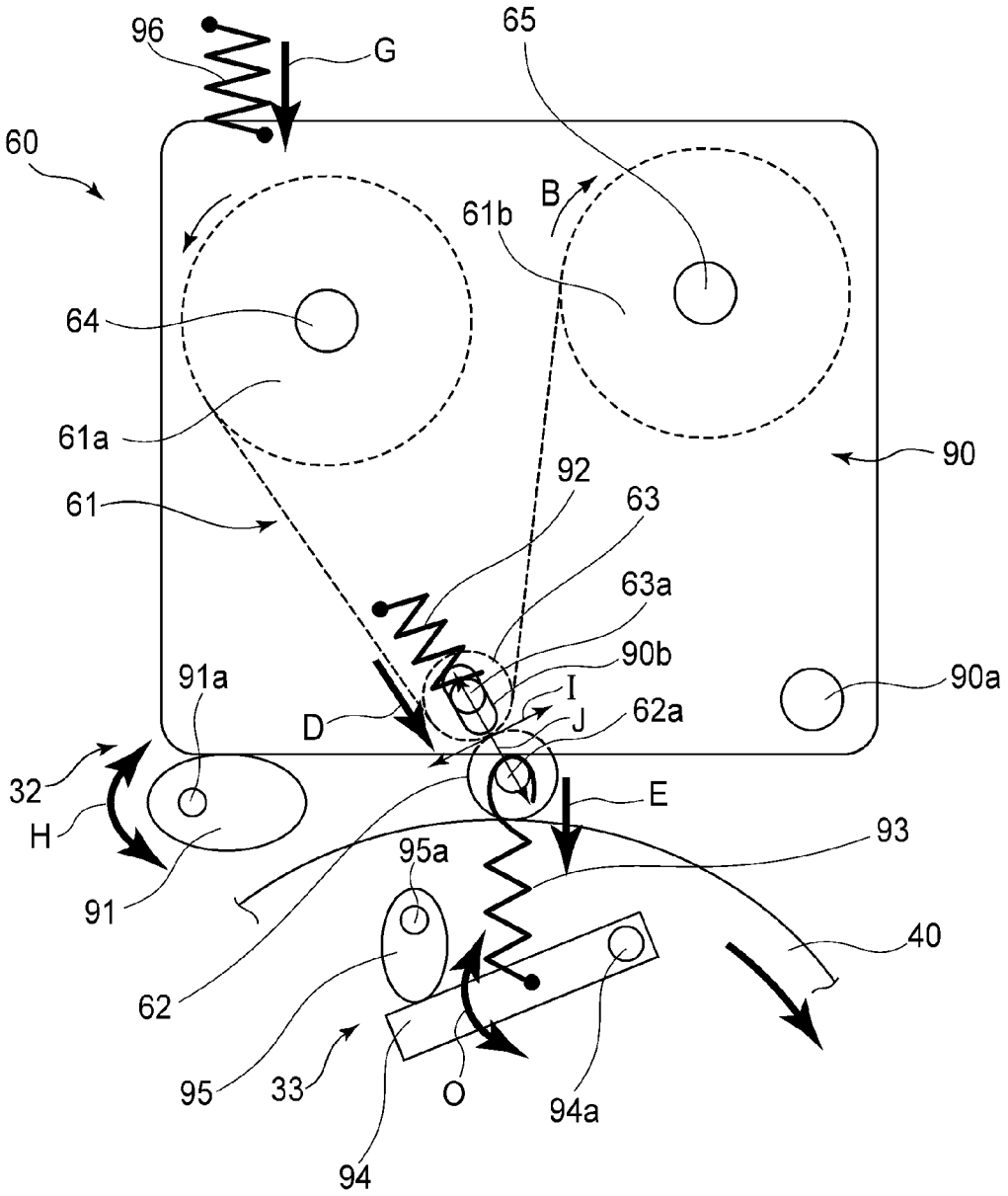
FIG. 3 is a schematic view showing a contact-and-separation mechanism for moving a web roller toward and away from a collecting roller.
Figure 4:
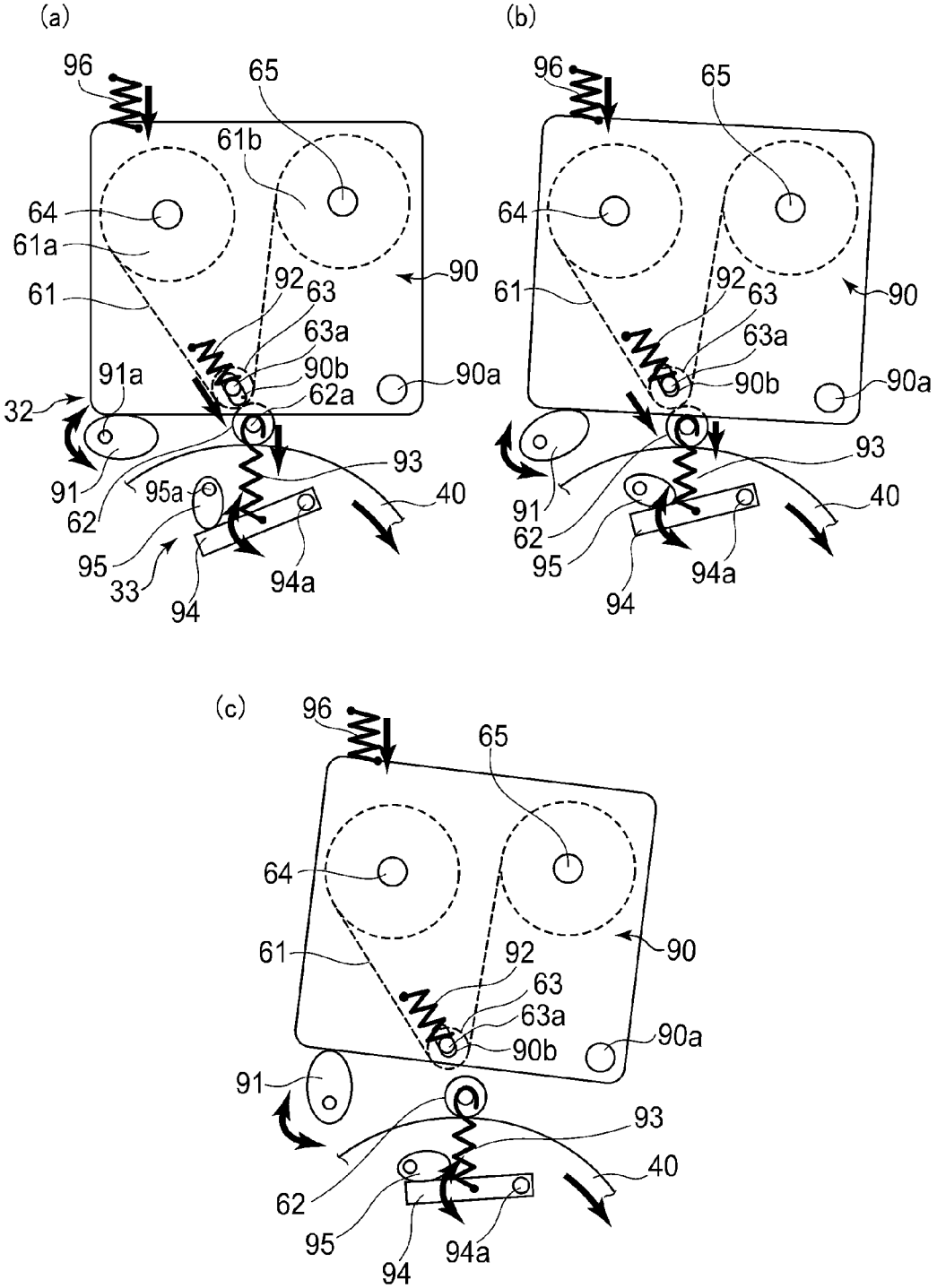
In FIG. 4, (a) to (c) are schematic views each showing a state of the contact-and-separation mechanism for the collecting roller and the web roller at a position.

Next, the fixing device 9 as the image heating apparatus will be described with reference to FIGS. 2 to 4 (*a*) to (*c*). FIG. 2 is a sectional view showing a structure of the fixing device 9 in this embodiment, FIG. 3 is a schematic view showing a contact-and-separation mechanism 32 for moving a web roller 63 toward and away from a collecting roller 62 along line J shown in FIG. 3, and (a) to (c) of FIG. 4 are schematic views each showing a state of the contact-and-separation mechanism 32 at a position.

As shown in FIG. 2, inside a casing 31 supported in the printer main assembly 16*a*, the fixing device 9 including a cleaning unit 60 provided at an upper portion is disposed. In the fixing device 9, an opposite roller 41 as a rotatable opposite member is press-contacted to a fixing roller 40 as a rotatable heating member, for heating the recording material S, at a total pressure of, e.g., about 784 (N) (about 80 (kg)), so that the heating nip n3 of the recording material S is formed.

In this way, the opposite roller (rotatable opposite member) 41 is contacted to the fixing roller (rotatable heating member) 40, so that the heating nip n3 for heating the image (toner image) on the recording material S. In the fixing device 9, the (unfixed) toner image T secondary-transferred on the recording material S is nipped and fed in the heating nip n3 between the fixing roller 40, to be contacted to the image surface, and the opposite roller 41, and thus is fixed on the recording material S. Referring to FIG. 2, in front of the fixing device 9, pre-fixing guides 25 and 26 are provided, and behind the fixing device 9, a post-fixing guide 27 is provided. Further, the recording material S is fed into the fixing device 9 through an entrance opening 28 and comes out of the fixing device 9 through an exit opening 29.

The fixing roller 40 is constituted as a cylindrical shape having, e.g., a diameter of 60 mm by disposing, e.g., a 3 mm-thick elastic layer 40*c* on an outer peripheral surface of an aluminum cylindrical metal core 40*b*. A lower layer of the elastic layer 40*c* is a HTV (high-temperature vulcanizing) silicone rubber layer, and on an outer peripheral surface of the HTV silicone rubber layer, an RTV (room-temperature vulcanizing) silicone rubber layer as a heat-resistant parting layer 40*d* to be contacted to the image surface is disposed.

On the elastic layer 40*c*, in order to improve a parting property with the toner, a fluorine-containing resin material (PFA tube in this embodiment) as a heat-resistant parting layer 40*d* is coated. Further, at a center portion of the core metal 40*b* of the fixing roller 40 a fixing roller heater 40*a* consisting of a halogen heater, having predetermined rated electric power, for heating the fixing roller 40 from an inside so that a surface temperature of the fixing roller 40 becomes a predetermined temperature is provided non-rotatably. This fixing roller heater 40*a* functions as a heating mechanism for heating the fixing roller 40 and also has the function of heating the collecting roller 62 as a rotatable collecting member.

Figure 5:
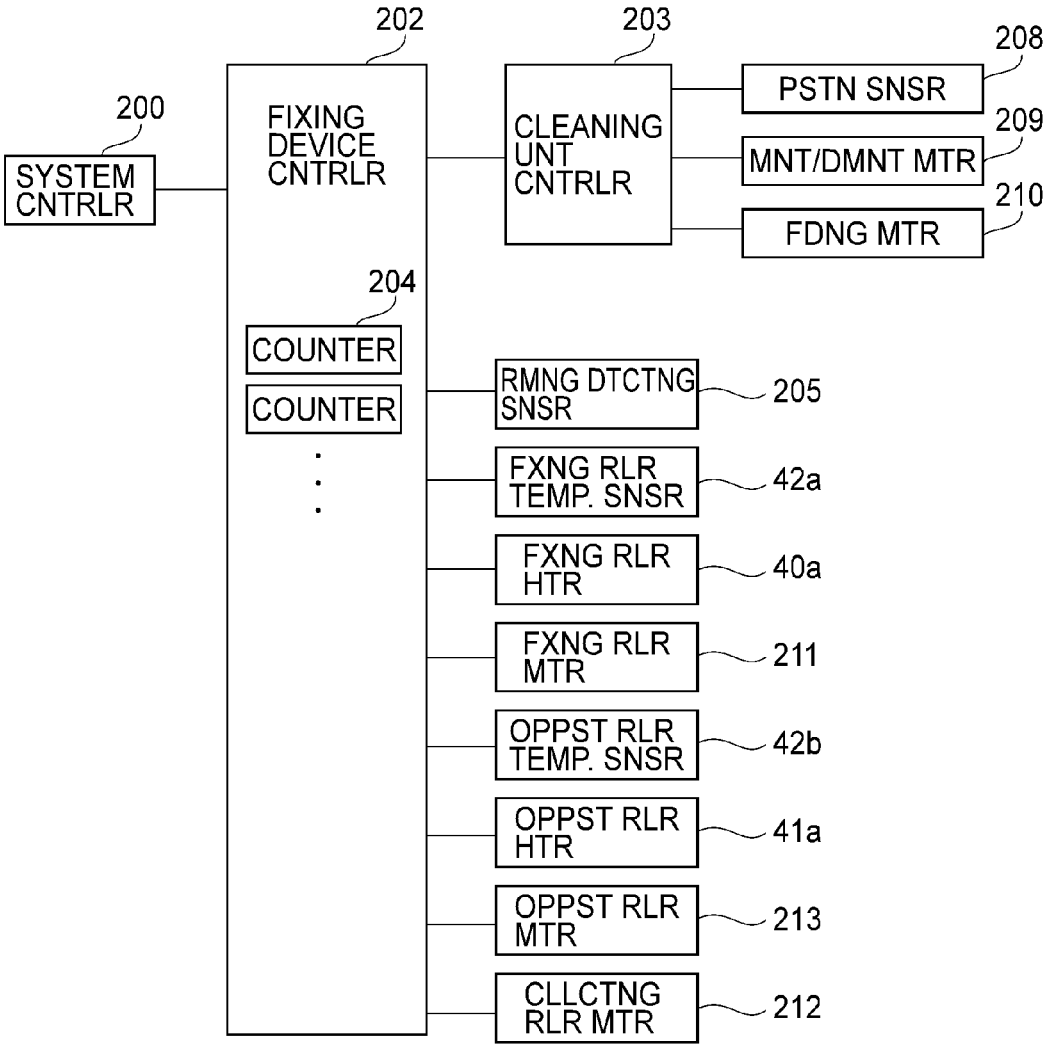
FIG. 5 is a block diagram showing a control system.

The fixing roller heater 40*a* is a heating source for heating the surface of the fixing roller (rotatable member) 40 up to a set temperature, and the set temperature is charged by control thereof by a fixing device controller 202 (FIG. 5). The fixing device controller 202 also functions as an executing portion. That is, the fixing device controller 202 controls an operation of the fixing roller heater 40*a* on the basis of an output of a fixing roller temperature sensor (detecting device) 42*a*.

On the other hand, the opposite roller 41 disposed so as to oppose the fixing roller 40 is constituted as a cylindrical shape having, e.g., a diameter of 60 mm by disposing, e.g., a 1 mm-thick elastic layer 41*c* on an outer peripheral surface of an aluminum cylindrical core metal 41*b*. A lower layer of the elastic layer 41*c* is a HTV silicone rubber layer, and on an outer peripheral surface of the HTV silicone rubber layer, a fluorine-containing resin layer is disposed.

On the elastic layer 41*c*, in order to improve a parting property with the toner, a heat-resistant parting layer 41*d* is coated. Further, at a center portion of the metal core 41*b* of the opposite roller 41, an opposite roller heater 41*a* having predetermined rated electric power, for heating the opposite roller 41 from an inside so that a surface temperature of the opposite roller 41 becomes a predetermined temperature is provided non-rotatably.

In this embodiment, by combining the fixing roller 40 and the opposite roller 41 each having the above-described layer structure, the parting property against a sharp-melt toner is further improved. Further, in order to fix double-side images, not only at the surface of the fixing roller 40 but also at the surface of the opposite roller 41, the above-described parting layer (40*d* or 41*d*) of RTV or LTV (low-temperature vulcanizing) silicone rubber or the like having a high toner parting effect is provided.

Each of the fixing roller 40 and the opposite roller 41 is rotatably supported at end portions thereof by ball bearings (not shown). Each of the fixing roller 40 and the opposite roller 41 is provided with a gear (not shown) at one of shaft end portions thereof, and these gears of the rollers 40 and 41 are connected with each other by a gear mechanism (not shown), so that the rollers 40 and 41 are rotationally driven integrally by an unshown driving mechanism in arrow K and L directions, respectively.

In the casing 31, a fixing roller temperature sensor (detecting device) 42*a* such as a thermistor is provided so as to detect a surface temperature of the fixing roller 40 in contact with the surface of the fixing roller 40. The fixing roller temperature sensor 42*a* is disposed upstream of the heating nip n3 with respect to the rotational direction of the fixing roller 40. The fixing roller temperature sensor 42*a* is connected with the fixing device controller 202 (FIG. 5). The fixing roller temperature sensor 42*a* constitutes a detecting mechanism for detecting the temperature of the fixing roller (rotatable heating member) 40. The fixing device controller 202 adjusts electric power supplied to the fixing roller heater 40*a* so that the surface temperature of the fixing roller 40 detected by the fixing roller temperature sensor 42*a* converges to a predetermined temperature (e.g., about 165° C.).

In the casing 31, an opposite roller temperature sensor 42*b* such as a thermistor is provided so as to detect a surface temperature of the opposite roller 41 in contact with the surface of the opposite roller 41. The opposite roller temperature sensor 42*b* is disposed upstream of the heating nip n3 with respect to the rotational direction of the opposite roller 41. The opposite roller temperature sensor 42*b* is connected with the fixing device controller 202 (FIG. 5). The fixing device controller 202 adjusts electric power supplied to the opposite roller heater 41*a* so that the surface temperature of the opposite roller 41 detected by the opposite roller temperature sensor 42*b* converges to a predetermined temperature (e.g., about 140° C.).

[Cleaning Unit]

As shown in FIGS. 2 and 3, the cleaning unit 60 for cleaning the fixing roller 40 includes the collecting roller 62 as the rotatable collecting member (rotatable cleaning member) formed of stainless steel (SUS 303) in an outer diameter of, e.g., 20 (mm). This collecting roller 62 is constituted so as to be rotated by rotation of the fixing roller 40. The collecting roller 62 collects the toner from the fixing roller (rotatable member) 40. Further, the cleaning unit 60 includes a cleaning web 61 formed with a nonwoven fabric. The cleaning web (cleaning sheet) 61 slides with the collecting roller 62, and removes the toner collected by the collecting roller 62.

The collecting roller 62 is rotatably supported by a rotation shaft 62*a* supported at end portions by the casing 31, and is also constituted so that pressure to be applied to the fixing roller (rotatable member) 40 is capable of being switched by a pressure switching mechanism 33 as a pressure switching means. The pressure switching mechanism 33 is constituted by a collecting roller urging cam 95, a collecting roller urging arm 94 and a collecting roller urging spring 93 which are described later.

In the case where the toner is peeled off from the recording material S and is deposited as offset toner (residual toner) on the fixing roller 40, the collecting roller 62 cleans the fixing roller 40 and collects the offset toner from the fixing roller 40. The collecting roller 62 is always contacted to the fixing roller 40 for the purpose of collecting a deposited matter, such as a foreign matter, on the surface of the fixing roller 40 also in a period other than during image formation.

In this embodiment, a constitution in which the collecting roller 62 is contacted to the fixing roller 40 as the rotatable member to clean the surface of the fixing roller 40 is employed. However, the present invention is not limited thereto, and a constitution in which the collecting roller 62 is contacted to the opposite roller 41 to clean the surface of the opposite roller 41 may also be employed. In this case, the opposite roller 41 constitutes the rotatable member in the present invention, and the opposite roller heater 41*a* of the opposite roller 41 constitutes the heating source for heating the surface of the opposite roller 41 (rotatable member) up to the set temperature. The set temperature for the opposite roller 41 is changed by control by the fixing device controller 202. Also by employing such a constitution, an effect similar to that in the case where the collecting roller 62 is contacted to the fixing roller 40 can be obtained. Such a constitution is also applicable to a modified embodiment described later.

The cleaning unit 60 includes a feeding (sending) roller 64 about which a feeding end portion 61*a* of the cleaning web 61 is wound and a winding-up roller 65 for winding up a winding end portion 61*b* of the cleaning web 61 fed from the feeding roller 64. Further, the cleaning unit 60 includes a web roller as an urging (pressing) roller for pressing the cleaning web 61 against the collecting roller 62. The pressure of the web roller 63 applied to the collecting roller 62 is switched by the contact-and-separation mechanism (moving mechanism) 32. The contact-and-separation mechanism 32 is constituted by a roller supporting plate 90, an elongated hole 90*b* formed in the roller supporting plate 90, an elliptical mounting-and-demounting cam 91, a web roller urging spring 92 consisting of a compression spring, and a unit urging spring 96 consisting of a compression spring, which are described later.

The contact-and-separation mechanism 32 moves the cleaning unit 60 (web roller 63) so that the web roller 63 can move the collecting roller 62 to a first position (position shown in (a) of FIG. 4), a second position (position shown in (b) of FIG. 4) and a third position (position in (c) of FIG. 4). The first position is, as shown in (a) of FIG. 4, the position where the cleaning web 61 contacts the collecting roller 62. The second position is, as shown in (b) of FIG. 4, the position where the cleaning web 61 contacts the collecting roller 62 at a contact pressure lower than the contact pressure at the first position. The third position is, as shown in (c) of FIG. 4, the position where the cleaning web 61 is spaced from the collecting roller 62. This potential for movement of the roller 63 is also illustrated by the double-headed arrow C in FIGS. 2 and 7.

In the casing 31 in FIG. 2, the roller supporting plate 90 shown in FIG. 3 is disposed in each of front and rear sides of FIG. 2 correspondingly to associated ones of end portions of the rollers 63, 64 and 65 of the cleaning unit 60. By the roller supporting plates 90 and 90 disposed in the front and rear sides, each of the web roller 63, the feeding roller 64 and the winding-up roller 65 are supported at end portions thereof. The roller supporting plates 90 are supported so as to be rotatable about a unit rotation shaft 90*a* as a fulcrum in the clockwise direction and the counterclockwise direction in FIG. 3.

The end portions of the cleaning web 61 is rotatably supported by the feeding roller 64 and the winding-up roller 65, and a feeding motor 210 (FIG. 5) for winding up the cleaning web 61 is connected with the cleaning web 61. When the feeding motor 210 rotates in a winding-up direction, the winding end portion 61*b* is wound up by the winding-up roller 65, whereby the cleaning web 61 advances in an arrow D direction to pass through the web roller 63. Then, the feeding end portion 61*a* is pulled, whereby the feeding roller 64 is rotated. As a result, the cleaning web 61 is gradually wound up in an arrow B direction.

The web roller 63 is provided so that a rotation shaft 63*a* formed of high-rigidity metal (SUS 303) penetrates through a center of the web roller 63 in order to suppress flexure (bending) when the cleaning web 61 is pressed against the collecting roller 62 by the web roller 63. Each of the roller supporting plates 90 provided in the front and rear sides is provided with the elongated hole 90*b* formed at a position opposing the collecting roller 62 contacting an upper portion of the fixing roller 40. Into these elongated holes 90*b*, end portions of the rotation shaft 63*a* are inserted slidably, respectively. The end portions of the rotation shaft 63*a* of the web roller 63 are urged toward the collecting roller 62 by the web roller urging springs 92 supported at one ends by the roller supporting plates 90 provided in the front and rear sides.

The web roller 63 may preferably have a nip width formed between itself and the collecting roller 62 in order to improve cleaning power by the cleaning web 61, and therefore a silicone sponge which has a heat-resistant property and which is, e.g., 30 mm in diameter is wound around the rotation shaft 63*a*. Further, this silicone sponge is coated with a FPA tube, for preventing deposition of the toner, having a thickness of, e.g., 100 μm.

At an upper portion of the roller supporting plate 90 in a side opposite from the unit rotation shaft 90*a*, the unit urging spring 96 supported at one end thereof by the casing 31 is supported at the other end thereof. At an upper-like portion of the fixing roller 40 in FIG. 3, the elliptical mounting-and-demounting cam 91 having an eccentric rotation shaft 91*a* which is one of two focuses is disposed so as to be substantially at the same level as the collecting roller 62 with respect to a horizontal direction. The roller supporting plate 90 urged in an arrow G direction by the unit urging spring 96 effects contact and separation (spacing) between the collecting roller 62 and the cleaning web 61 with the unit rotation shaft 90*a* as the fulcrum with rotation of the mounting-and-demounting cam 91 in a state in which a lower-left portion thereof is pressed against the mounting-and-demounting cam 91.

The rotation shaft 63*a* of the web roller 63 is rotatably and slidably supported by the elongated hole 90*b*. An extension direction J of the rotation shaft 63*a* is a direction perpendicular to an extension direction (arrow I direction) of the nip between the cleaning web 61 (contacting the web roller 63) and the collecting roller 62.

The collecting roller 62 is supported by the casing 31 at end portions of the rotation shaft 62*a* by unshown ball bearings so that the collecting roller 62 is movable in advancing and retracting directions relative to the fixing roller 40. The collecting roller 62 is constituted so as to be pressed against the fixing roller 40, while the contact pressure thereof toward the fixing roller 40 is stepwisely switched, by the pressure switching mechanism 33 including the collecting roller urging spring 93, the collecting roller urging arm 94 and the collecting roller urging cam 95 (FIG. 4). The collecting roller urging cam 95 is constituted in an elliptical shape such that one of two focuses thereof is an eccentric rotation shaft 95*a*.

The collecting roller urging spring 93 consisting of a tension spring is supported at one end thereof by an end portion of the rotation shaft 62*a* of the collecting roller 62 and is supported at the other end thereof by a central portion of the collecting roller urging arm 94. By rotation of the collecting roller urging cam 95, the collecting roller urging arm 94 swings about a rotation shaft 94*a* in an arrow O direction. By the swing, an operating length of the collecting roller urging spring 93 changes, so that the pressure of the collecting roller 62 applied to the fixing roller 40 is changed. A variable range of the pressure is set from 0 N to 80 N.

For example, in a state in which the toner is deposited in a large amount on the collecting roller 62, when the nip pressure between the fixing roller 40 and the collecting roller 62 is excessively high, there is a high possibility that the toner is transferred back to the fixing roller 40. For that reason, in the case where the toner is large in amount after generation of a jam or the like, the nip pressure between the collecting roller 62 and the fixing roller 40 may preferably be lowered to the possible extent. However, in order to prevent slip of the collecting roller 62, the contact pressure of the collecting roller 62 may preferably be determined so that a frictional force F2 (FIG. 2) between the cleaning web 61 and the collecting roller 62 is smaller than a frictional force F1 (FIG. 2) between the collecting roller 62 and the fixing roller 40.

Therefore, the nip pressure between the collecting roller 62 and the fixing roller 40 is lowered to the possible extent, so that the contact pressure is determined so as to satisfy F2<F1. In a state in which the cleaning web 61 is spaced from the collecting roller 62 (in the third position, i.e., in a separation (spacing) mode ((c) of FIG. 4)), a set value of the pressure of the collecting roller urging spring 93 is ON, so that a contact state of the collecting roller 62 with the fixing roller 40 is maintained only by the self-weight of the collecting roller 62, as shown by arrow E in FIG. 3.

The collecting roller 62 is rotated by rotation of the fixing roller 40 by transmitting a driving force from the fixing roller 40 to the collecting roller 62. In a state in which the cleaning web 61 is contacted to the collecting roller 62 by the web roller 63, when the fixing roller 40 is rotated, the toner collected from the fixing roller 40 onto the collecting roller 62 by rotation of the collecting roller 62 rotated by the rotation of the fixing roller 40 is removed by the cleaning web 61. In that case, web 61 contacting the collecting roller 62 is gradually wound up in the arrow B direction, so that a fresh (new) portion thereof contacts the collecting roller 62 before an associated portion of the cleaning web 61 is saturated with the toner.

Next, with reference to FIG. 5, a control system in this embodiment will be described. FIG. 5 is a block diagram showing the control system for effecting contact-and-separation control of the cleaning unit 60 in this embodiment.

That is, the printer 16 (FIG. 1) includes an entire system controller 200 for effecting integral control of the respective portions, and a fixing device controller 202 is connected with the entire system controller 200.

In the fixing device controller 202, a plurality of counters 204 are provided. To the fixing device controller 202, a cleaning unit controller 203, a remaining detecting sensor 205, a fixing roller temperature sensor 42*a*, the fixing roller heater 40*a* and the fixing roller motor 211 are connected. Further, to the fixing device controller 202, an opposite roller temperature sensor 42*a*, the opposite roller heater 41*a*, an opposite roller motor 213 and a collecting roller motor 212 are connected.

The temperature of the collecting roller 62 follows the temperature of the fixing roller 40, and therefore, temperature control of the collecting roller 62 is made by temperature adjustment (temperature control) of the fixing roller 40. That is, the fixing device controller 202 controls the temperature of the collecting roller (rotatable cleaning member) 62 via the fixing roller 40 by controlling an operation of the fixing roller heater 40*a* on the basis of an output of the fixing roller temperature sensor 42*a*.

To the cleaning unit controller 203 described above, a position sensor 208 for detecting a home position of the web roller 63 relative to the collecting roller 62 and a mounting-and-demounting motor 209 for mounting and demounting the cleaning web 61 relative to the collecting roller 62 by rotating the mounting-and-demounting cam 91 are connected. Further, to the cleaning unit controller 203, the feeding motor 210 for winding up the cleaning web 61 by rotating the winding-up roller 65 is connected.

The fixing device controller 202 also functions as an executing portion for executing an operation in a cleaning mode in which the collecting roller 62 is cleaned at the second position ((b) of FIG. 4) and the first position ((a) of FIG. 4) in the listed order. The fixing device controller 202 controls whether or not the cleaning mode should be started, on the basis of an output of the fixing roller temperature sensor 42*a*.

The fixing device controller 202 effects the following control in accordance with an instruction from the entire system controller 200, on the basis of detection signals from the fixing roller temperature sensor 42*a* and the opposite roller temperature sensor 42*b*. That is, the fixing device controller 202 contacts not only the cleaning unit 60 via the cleaning unit controller 203 but also each of the fixing roller heater 40*a*, the fixing roller motor 211, the collecting roller motor 212, the opposite roller heater 41*a* and the opposite roller motor 213.

The fixing device controller 202 is constituted so that the operation in the separation mode ((c) of FIG. 4) is executable via the cleaning unit controller 203. At the first position ((a) of FIG. 4), by controlling the pressure switching mechanism (pressure switching means) 33 and the contact-and-separation mechanism 32, the collecting roller 62 is contacted to the fixing roller (rotatable member) 40 at a high pressure (e.g., 45N). At the second position ((b) of FIG. 4), by controlling the pressure switching mechanism 33 and the contact-and-separation mechanism 32, the collecting roller 62 is contacted to the fixing roller 40 at a low pressure (e.g., 20N). At the third position (separated (spaced) position), by controlling the pressure switching mechanism 33 and the contact-and-separation mechanism 32, the cleaning web 61 is spaced from the collecting roller 62.

The fixing device controller 202 controls the temperature of the collecting roller 62 so that the temperature of the collecting roller 62 when the cleaning unit 60 is moved from the third position ((c) of FIG. 4) to the second position ((b) of FIG. 4) is higher than the temperature of the collecting roller 62 when the cleaning unit 60 is moved from the second position ((b) of FIG. 4) to the first position ((a) of FIG. 4). As a result, it is possible to suppress a phenomenon, such that the cleaning web 61 is unintentionally pulled out or that the toner is transferred back to the fixing roller 40, while improving a cleaning property.

The fixing device controller 202 controls the fixing roller heater 40*a* and starts a lowering in temperature of the collecting roller 62 from a temperature in a state in which the cleaning unit 60 is located in the second position. As a result, the temperature at the time of starting the cleaning at the first position can be made lower than the temperature at the time of starting the cleaning at the second position.

The cleaning unit controller 203 rotates the mounting-and-demounting cam 91 in the clockwise and counterclockwise directions as shown by the double-headed arrow H in FIG. 3 by driving the mounting-and-demounting motor 209 while discriminating the position of the web roller 63 relative to the collecting roller 62 by the position sensor 208. At the same time, the cleaning web 61 is mounted on and demounted from the collecting roller 62 while being wound up by drive of the feeding motor 210.

The remaining detecting sensor 205 detects the recording material S remaining in the fixing device 9 during jam generation or the like, and then sends a detection signal of the recording material S to the fixing device controller 202.

The fixing roller temperature sensor 42*a* detects the surface temperature of the fixing roller 40, and then sends its detection signal to the fixing device controller 202. A heat generation temperature of the fixing roller heater 40*a* is adjusted by control by the fixing device controller 202, so that the surface temperature of the fixing roller 40 is adjusted, but constitutes a temperature adjusting means for adjusting the surface temperature of the collecting roller (cleaning member) 62 on the basis of the surface temperature of the fixing roller 40. The fixing roller motor 211 rotates the fixing roller 40 in the arrow K direction in FIG. 2 by the control by the fixing device controller 202.

The opposite roller temperature sensor 42*b* detects the surface temperature of the opposite roller 41, and then sends its detection signal to the fixing device controller 202. The heat generation temperature of the opposite roller heater 41*a* is adjusted by the control by the fixing device controller 202, so that the opposite roller heater 41*a* adjusts the surface temperature of the opposite roller 41. The opposite roller motor 213 rotates the opposite roller 41 in the arrow L direction in FIG. 2 by the control by the fixing device controller 202.

The fixing device controller 202 rotates the collecting roller urging cam 95 by driving the collecting roller motor 212 while discriminating the position of the collecting roller 62 relative to the fixing roller 40, so that the collecting roller 62 is contacted to and spaced from the fixing roller 40.

The cleaning during the jam generation is performed in the following manner in order to suppress a pulling-out phenomenon of the cleaning web 61 when the toner is deposited (closely) on the entire surface of the collecting roller 62 due to the jam generation.

That is, the collecting roller 62 does not include a heat source, and therefore the fixing device controller 202 increases a (temperature) control temperature of the fixing roller 40 up to 150° C., and thus increases the temperature of the collecting roller 62 up to 150° C., so that temperature adjustment of the collecting roller 62 is performed from the fixing roller 40 side.

Then, the cleaning web 61 is contacted to the collecting roller 62 at the low pressure (e.g., 20N) generated via the web roller 63, and the collecting roller 62 is contacted to the fixing roller 40 at the high pressure (e.g., 45N). From immediately after start of the cleaning, the control temperature of the fixing roller 40 is changed to, e.g., 140° C., so that the temperature of the collecting roller 62 is gradually lowered.

Then, after the cleaning is performed for a certain time at the high pressure (second pressure), the temperature of the collecting roller 62 is lowered to about 140° C. At this time, the contact pressure of the cleaning web 61 is increased to, e.g., 40N, and the contact pressure between the collecting roller 62 and the fixing roller 40 is increased to, e.g., 90N, so that it is possible to start finishing cleaning.

As described above, first, the cleaning is performed at the low pressure, and therefore even when the toner is deposited in a large amount on the collecting roller 62, the frictional force in the nip between the cleaning web 61 and the collecting roller 62 can be lowered by lowering the extent of the normal reaction between the cleaning web 61 and the collecting roller 62. As a result, it is possible to prevent the inconvenience that the cleaning web 61 is pulled out from the winding-up roller 65.

Then, the temperature of the collecting roller 62 at the time of starting the cleaning is set at a high temperature of, e.g., 150° C. at the second position, and is set at a low temperature of, e.g., 140° C. at the first position. This is because a viscosity of the toner is lowered compared with normal cleaning carried out at, e.g., about 140° C., and thus the frictional force exerted on the cleaning web 61 is alleviated. As a result, it is possible to improve a toner collecting property of the cleaning web 61 while more effectively suppressing a degree of the pulling-out of the cleaning web 61.

In this case, there is a liability that a transfer-back phenomenon of the toner onto the fixing roller 40 generates due to an increase in temperature. However, the transfer-back phenomenon is correlated with the pressure and the temperature, and therefore a margin again the transfer-back of the toner is broadened toward a high temperature direction by lowering the nip pressure between the collecting roller 62 and the fixing roller 40 from a normal pressure of 90N to 45N. For that reason, the transfer-back of the toner can be suppressed.

Figure 6:
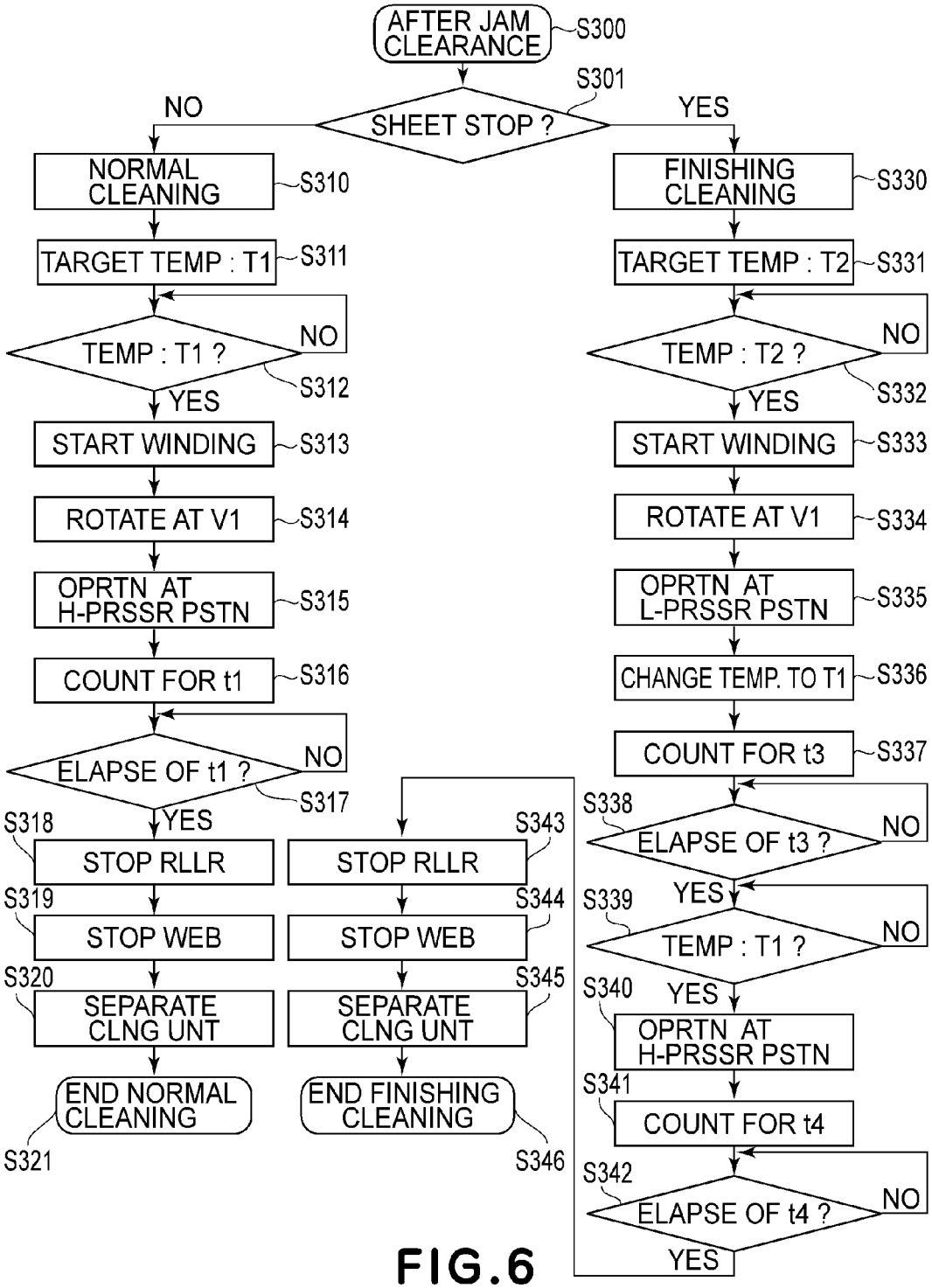
FIG. 6 is a flowchart relating to a cleaning process.

Next, the action (function) of this embodiment will be described with reference to FIGS. 4 (*a*) to (*c*) and 6. FIG. 6 is a flowchart for illustrating a process of carrying out normal cleaning, low pressure cleaning and high pressure cleaning.

That is, the fixing device controller 202, executing its operations in accordance with an instruction from the entire system controller 200 detects, via the remaining detecting sensor 205, whether or not the recording material S exists in the fixing device 9 during the jam generation. That is, in the printer 16, the fixing device controller 202 discriminates that a jam is generated when a sensor (not shown) does not detect the recording material S in a certain time set in advance, and then displays a message, to the effect that a jam has been generated on an unshown display portion, and after jam clearance by a user is executed, executes a sequence of recovering from the jam state. The cleaning unit controller 203 effects, during a recovery process of the sequence of recovering from the jam state after the jam clearance, control so that an operation in a cleaning mode starting from a step S330 is executed. After the execution of this operation in the cleaning mode, image formation by control by the entire system controller 200 is resumed.

In the case where the absence of the recording material S in the fixing device 9 becomes clear after jam clearance (S300) ("NO" of S301), normal cleaning is started (S310). In the normal cleaning operation, first, the fixing device controller 202 turns on the fixing roller heater 40*a* provided inside the fixing roller 40, and the temperature of the fixing roller 40 is increased so as to become a target temperature T1 (140° C.) while being measured by the fixing roller temperature sensor 42*a* (S311). Then, when the surface temperature of the fixing roller 40 reaches the target temperature T1 (140° C.) ("YES" of S312), the fixing device controller 202 starts a winding-up operation of winding-up the cleaning web 61 (S313). By drive of the web feeding motor 210, the winding end portion 61*b* of the cleaning web 61 is wound up about the winding-up roller 65 at a speed of 1.0 mm/sec. Subsequently, rotation of the fixing roller 40 is started at a speed V1 (e.g., 200 mm/sec) (S314), so that the collecting roller 62 is rotated by the rotation of the fixing roller 40. Therefore, the rotational speed of the collecting roller 62 equals to the speed V1 (200 mm/sec).

Thereafter, a mounting operation of mounting the cleaning unit 60 and a pressing operation of pressing the collecting roller 62 are started at a high pressure position, and the mounting-and-demounting cam 91 is rotated to a position where a nip pressure (N2) between the web roller 63 and the collecting roller 62 is 40N, so that the cleaning web 61 is contacted to the collecting roller 62 (S315). At the same time, the collecting roller urging cam 95 is rotated so that the pressure N1 between the collecting roller 62 and the fixing roller 40 is 90N (S315). Hereinafter, this position is referred to as the high pressure position ((a) of FIG. 4). In this case, jammed paper (jammed recording material) is in a state in which the jammed paper does not exist in the fixing device 9 ("NO" of S301), and therefore the amount of the toner on the collecting roller 62 is very small. Accordingly, even when the pressure of the collecting roller 62 is increased, the transfer-back of the toner onto the fixing roller 40 does not occur.

The fixing device controller 202 starts count of the cleaning for a certain time t1 (e.g., 40 sec) by a counter 204 (S316). Then, when the counter 204 reaches the certain time t1 ("YES" of S317), the rotation of the fixing roller 40 is stopped (S318), and then the feeding motor 210 is stopped, and thus the winding-up of the cleaning web 61 is stopped (S319).

Thereafter, the fixing device controller 202 starts a separating (spacing) operation of separating (spacing) the cleaning unit 60 and a pressure-reducing operation of the collecting roller 62 (S320). Then, when the cleaning unit 60 reaches a separated (spaced) position and the collecting roller urging cam 95 reaches a position where the pressure of the web roller urging spring 92 for the collecting roller 62 is ON ((c) of FIG. 4), a normal cleaning flow is ended (S321).

On the other hand, during jam generation, in the case where the fixing device controller 202 discriminates, via the remaining detecting sensor 205, that the recording material S remains in the fixing device 9 ("YES" of S301), the fixing device controller 202 starts low pressure and finishing cleaning (S330).

In the case where the jam is generated in the fixing device 9 due to improper separation of the recording material S or the like, the recording material S adheres to the fixing roller 40 or the collecting roller 62, so that the toner is deposited over the surface of the collecting roller 62 in some cases. After jam clearance (removal of the jammed (stagnated) recording material S by the user), when the collecting roller 62 is rotationally driven for cleaning the collecting roller 62 in a state of contact of the cleaning web 61 with the collecting roller 62 at a pressure of not less than a certain value, there is a risk that the toner is transferred back in a large amount onto the fixing roller 40. Further, there is a possibility that the cleaning web 61 is pulled due to a viscoelastic property and an adhesive property of the toner deposited on the collecting roller 62, so that the cleaning web 61 is reversely rotated, and thus the web 61 is pulled out.

A one-way gear (not shown) for preventing reverse rotation is provided at the winding end portion 61*b*, and therefore a center shaft of the winding-up end portion 61*b* is not rotated, but when the cleaning web 61 remains in a large amount in the web-up side, there is a possibility that the cleaning web 61 is pulled out while being tightly squeezed. When the winding-up side of the cleaning web 61 is pulled out, the cleaning web 61 becomes entangled with the collecting roller 62 or the fixing roller 40, so that there is a possibility that tearing of the cleaning web 61, breakage of the fixing roller 40 and breakage of the sensors and the respective members which contact the fixing roller 40 are caused to occur.

Therefore, by first cleaning the collecting roller 62 at the low pressure, the normal reaction between the cleaning web 61 and the collecting roller 62 is lowered even when the toner is deposited in the large amount on the collecting roller 62, so that the frictional force in the nip can be lowered, and thus it is possible to prevent the cleaning web 61 from being discharged (pulled out). That is, the cleaning unit controller 203 cleans, in the operation in the cleaning mode, the collecting roller 62 over a predetermined time in a state in which the cleaning web 61 is in the second position (S330), and thereafter moves the cleaning web 61 to the first position (S340).

Further, when the toner exists in the large amount on the collecting roller 62, when the nip pressure (N1) between the collecting roller 62 and the fixing roller 40 is equal to the pressure during the normal cleaning, there is a risk that the toner collected from the fixing roller 40 is transferred back onto the fixing roller 40. For that reason, a relationship between the frictional force F2 between the cleaning web 61 and the collecting roller 62 and the frictional force F1 between the collecting roller 62 and the fixing roller 40 is set to satisfy F2<F1, so that the nip pressure (N1) between the collecting roller 62 and the fixing roller 40 is made small to the extent possible. As a result, the margin against the transfer-back of the toner with respect to the temperature during the low pressure cleaning can be broadened.

First, the fixing device controller 202 turns on the fixing roller heater 40*a* in the fixing roller 40, and controls the turning-on of the fixing roller heater 40*a*, while measuring the surface temperature of the fixing roller 40 by the fixing roller temperature sensor 42*a*, so that the surface temperature is a target temperature T2 (e.g., 150° C.) (S331).

Then, in a step S332, the cleaning is started in the case where the fixing roller surface temperature is not less than the target temperature (predetermined temperature) T2 at the time such as immediately after passing of the thick paper. That is, the fixing device controller 202 starts the operation in the cleaning mode when the temperature of the collecting roller (rotatable cleaning member) 62 is not less than the predetermined temperature (T2). That is, when the temperature of the fixing roller 40 reaches the target temperature T2 (150° C.) ("YES" of S332), the fixing device controller 202 starts a web-up operation of winding-up the cleaning web 61 (S333). The fixing device controller 202 drives the feeding motor 210, so that the winding end portion 61*b* of the cleaning web 61 is wound up about the winding-up roller 65 at a speed of, e.g., 1.0 mm/sec.

On the other hand, when the temperature of the fixing roller 40 is less than the target temperature T2, i.e., in the case where the temperature of the fixing roller 40 is less than the predetermined temperature (T2) after the jam clearance ("NO" of S332), the fixing roller heater 40*a* is turned on, and the cleaning is not started until the temperature reaches the target temperature T2. In the case where the temperature of the collecting roller 62 is less than the predetermined temperature (T2), the cleaning unit controller 203 delays the start of the operation in the cleaning mode by keeping the cleaning web 61 at the third position ((c) of FIG. 4) until the temperature of the collecting roller 62 increases up to the predetermined temperature. In this way, in the case where the temperatures of the fixing roller 40 and the collecting roller 62 at the time of starting the cleaning are lower than the target temperatures, the operation in the cleaning mode can be started after these rollers are properly heated.

Subsequently, rotational drive of the fixing roller 40 is started at a speed V1 (e.g., 200 mm/sec) (S334), so that the collecting roller 62 is driven by the rotational drive of the fixing roller 40. Therefore, the rotational speed of the collecting roller 62 equals to the speed V1 (200 mm/sec).

Thereafter, the fixing device controller 202 starts a mounting operation of mounting the cleaning unit 60 and a pressing operation of pressing the collecting roller 62, and rotates the mounting-and-demounting cam 91 to a position where a nip pressure (N2) between the web roller 63 and the collecting roller 62 is, e.g., 20N, so that the cleaning web 61 is contacted to the collecting roller 62 (S335). At the same time, the collecting roller urging cam 95 is rotated so that a pressure between the collecting roller 62 and the fixing roller 40 is, e.g., 45N (S335). Hereinafter, this position is referred to as the low pressure position ((b) of FIG. 4).

Then, when the cleaning unit 60 starts the mounting operation, the fixing device controller 202 switches the target temperature T2 (e.g., 150° C.) of the fixing roller 40 to the target temperature T1 (e.g., 140° C.) (S336). At the same time, the fixing device controller 202 carries out the cleaning for a certain time t3 (e.g., 20 sec) counted by the counter 204 (S337).

Then, when the counter 204 reaches the certain time t3 ("YES" of S338) and the surface temperature of the fixing roller 40 reaches the target temperature T1 (140° C.) ("YES" of S339), the cleaning unit 60 is moved as follows. That is, the cleaning unit 60 is moved to the high pressure position ((a) of FIG. 4) where the nip pressure (N2) between the web roller 63 and the collecting roller 62 is, e.g., 40N and the nip pressure (N1) between the collecting roller 62 and the fixing roller 40 is, e.g., 90N (S340), and then finishing cleaning is started. In the operation in the cleaning mode during execution, when the cleaning web 61 cleans the collecting roller 62 at the first position ((a) of FIG. 4), the fixing device controller 202 maintains the temperature of the collecting roller 62 at the target temperature T1 which is less than the predetermined temperature (T2).

In a low pressure state, when the cleaning is made to some extent, the toner, in a very small amount, which cannot be completely removed at the low pressure remains on the surface of the collecting roller 62. In order to clean the surface of the collecting roller 62, after the cleaning for the certain time at the low pressure, the contact pressure is increased and the finishing cleaning is carried out for a certain time, so that the residual toner is properly removed.

Further, when the collecting roller 62 is kept at the low pressure position, there is a risk that the collecting roller 62 slips with the fixing roller 40, and therefore when the contact pressure of the cleaning web 61 is increased, also the contact pressure (N1) between the collecting roller 62 and the fixing roller 40 is increased correspondingly. In the case where the contact pressure is increased in this way, there is a risk of the generation of the transfer-back of the toner, unless the temperature of the collecting roller 62 is lowered. Accordingly, the fixing device controller 202 controls the fixing roller heater 40*a*, and starts a lowering of the surface temperature of the collecting roller 62 from the execution of the operation in the cleaning mode.

That is, in the case where the target temperature of the fixing roller 40 is lowered, when the target temperature of the fixing roller 40 is changed after the low pressure cleaning is ended, this change takes much time. Accordingly, in order to save the time to reduce a downtime, by lowering the target temperature immediately after the low pressure cleaning and then by gradually lowering the temperature, the temperature is caused to approach the target temperature at timing when the finishing cleaning is started.

The fixing device controller 202 carried out the cleaning for a certain time t4 (40 sec) by a counter 204 (S341), and then, when the counter 204 reaches the certain time t4 ("YES" of S342), the rotation of the fixing roller 40 is stopped (S343). Then, the feeding motor 210 is stopped, and thus the winding-up of the cleaning web 61 is stopped (S344). Thereafter, the fixing device controller 202 starts a separating (spacing) operation of separating (spacing) the cleaning unit 60 and a pressure-reducing operation of the collecting roller 62 (S345). Then, at the time when the cleaning unit 60 reaches a separated (spaced) position and the collecting roller urging cam 95 reaches a position where the pressure of the web roller urging spring 92 for the collecting roller 62 is ON ((c) of FIG. 4), a low pressure and finishing cleaning flow is ended (S346).

As described above, according to this embodiment, while improving the cleaning property, by suppressing the pulling-out of the cleaning web 61 and the transfer-back phenomenon that the transfer is transferred back onto the fixing roller 40, and the like, it is possible to provide the fixing device 9 having a constitution capable of stably carrying out good image formation.

Next, with reference to FIG. 7, a modified embodiment will be described. In this modified embodiment, members identical to those in the above-described embodiment are represented by the same reference numerals or symbols, and constitutions and functions of the members are the same as those in the above-described embodiment will be omitted from description.

Figure 7:
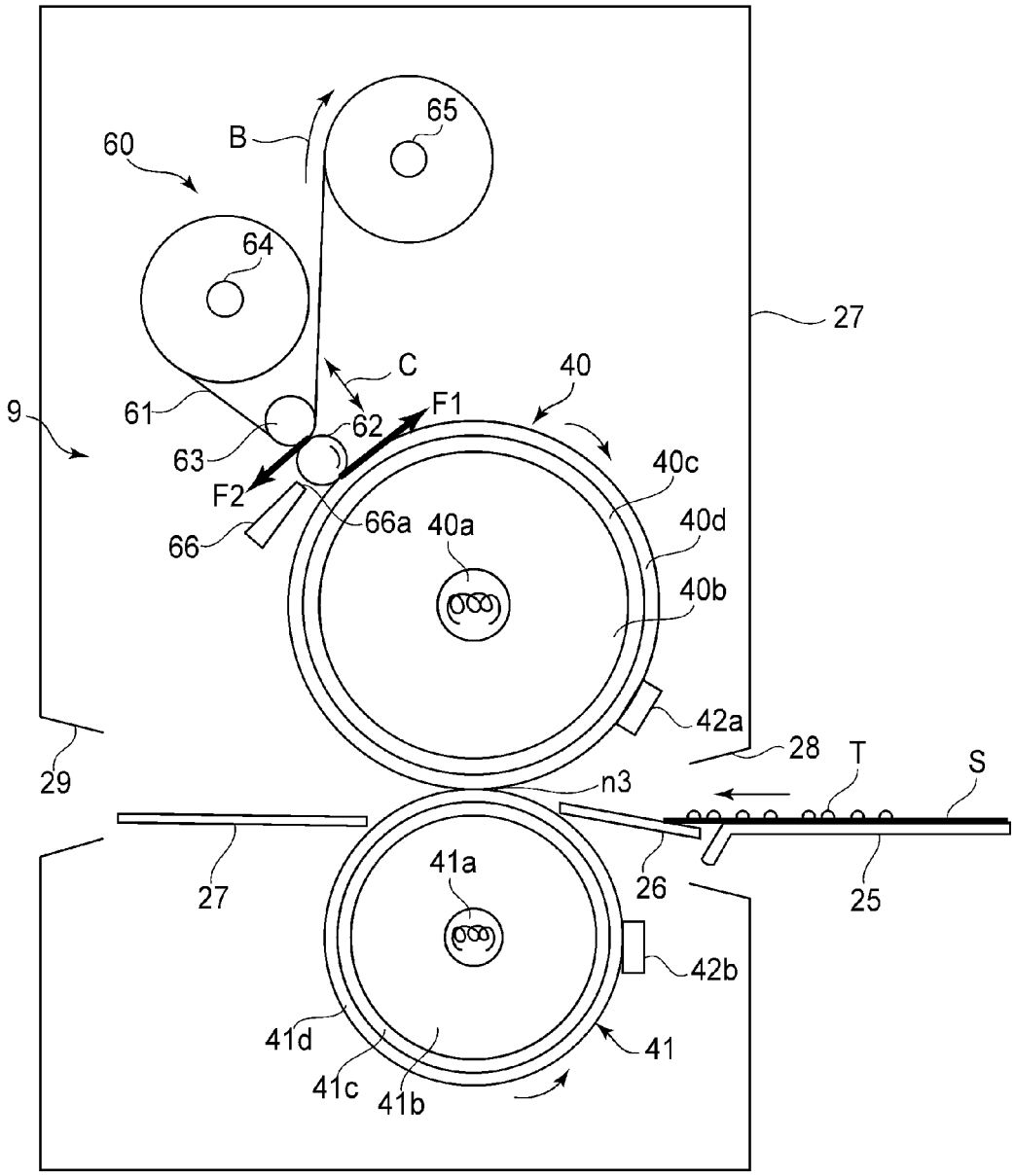
FIG. 7 is a sectional view for illustrating a modified embodiment.

In the modified embodiment, as shown in FIG. 7, a blowing device 66 for blowing air toward the collecting roller 62 through a blowing port 66*a* is provided adjacently to the collecting roller 62. The blowing device 66 is controlled by the fixing device controller 202 so as to cool the collecting roller 62, thereby lowering the surface temperature. In the modified embodiment, the fixing roller heater 40*a* and the blowing device 66 perform the function of the temperature adjusting means.

Also in the modified embodiment employing the above constitution, not only an effect similar to the effect of the above-described embodiment but also the function as the temperature adjusting means can be further improved by enhancing a cooling effect for the collecting roller 62.

According to the embodiment and the modified embodiment, in order to prevent the transfer-back of the toner onto the fixing roller 40 and the pulling-out of the cleaning web 61, in the cleaning during the jam generation, first, the temperature of the collecting roller 62 is set at the temperature higher than the normal cleaning temperature. Then, the cleaning web 61 is contacted to the collecting roller 62 at the low pressure, and then the collecting roller 62 is rotated. Then, when the cleaning is started, the set control temperature is lowered, and then the cleaning is performed for a certain time. Thereafter, the contact pressure is further increased in a state in which the temperature of the collecting roller 62 is lowered to the normal temperature, and then the finishing cleaning is performed.

First, by first cleaning the collecting roller 62 at the low pressure, the normal reaction between the cleaning web 61 and the collecting roller 62 is lowered even when the toner is deposited in the large amount on the collecting roller 62, so that the frictional force in the nip can be lowered, and thus it is possible to prevent the cleaning web 61 from being discharged (pulled out). Further, the reason why the temperature is in a first state at the high temperature is that the collecting property of the toner onto the cleaning web 61 is improved while effectively suppressing the pulling-out of the cleaning web 61 by lowering the viscosity of the toner thereby alleviating the frictional force exerted on the web 61. As described above, there is a risk that the transfer-back phenomenon of the toner onto the fixing roller 40 is generated due to the increase of the temperature, but the transfer-back of the toner is correlated with the pressure and the temperature, and therefore the margin against the transfer-back of the toner is broadened toward the high-temperature direction by creating the low pressure state. For this reason, it is possible to suppress the transfer-back of the toner.

In the low pressure state, when the cleaning is made to some extent, the toner, in a very small amount, which cannot be completely removed at the low pressure remains on the surface of the collecting roller 62. In order to clean the surface of the collecting roller 62, after the cleaning for the certain time at the low pressure, the contact pressure is increased and the finishing cleaning is carried out for a certain time, so that the residual toner is properly removed. At this time, the contact pressure is increased, and therefore when the control temperature is kept at the high temperature, the transfer-back of the toner onto the fixing roller 40 generates, but in the finishing cleaning, the temperature of the collecting roller 62 is lowered, so that the margin against the transfer-back of the toner in an amount corresponding to the increase in contact pressure is supplemented by the lowering in temperature, and thus the transfer-back of the toner is suppressed.

As a result, after the jam, even when the collecting roller 62 is in a state in which the toner is deposited over the surface thereof, it is possible to prevent the discharge (pulling-out) of the cleaning web 61 while suppressing the transfer-back of the toner onto the fixing roller 40. Further, breakage of the respective members such as the fixing roller 40 can be prevented, and it is possible to properly clean the surface of the collecting roller 62.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 045861/2014 filed Mar. 10, 2014, which is hereby incorporated by reference.

What is claimed is:

1. An image heating apparatus comprising:

a rotatable heating member configured to heat a toner image on a recording material;

a rotatable collecting member configured to collect a toner deposited on said rotatable heating member;

a cleaning web configured to clean said rotatable collecting member;

an urging roller configured to urge said cleaning web toward said rotatable collecting member;

a moving mechanism configured to move said urging roller so as to be movable between a first position where said cleaning web contacts said rotatable collecting member, a second position where said cleaning web contacts said rotatable collecting member at a contact pressure lower than the contact pressure at the first position, and a third position where said cleaning web is spaced from said rotatable collecting member;

an executing portion configured to execute an operation in a cleaning mode in which said rotatable collecting member is cleaned at the second position and the first position in this order; and a controller configured to control, in the operation in the cleaning mode, the temperature of said rotatable collecting roller so that the temperature when said urging roller is moved from the third position to the second position is higher than the temperature when said urging roller is moved from the second position to the first position.

2. An image heating apparatus according to claim 1, further comprising:

a detecting device configured to detect the temperature of said rotatable collecting member; and a heating mechanism configured to heat said rotatable heating member, wherein said controller controls an operation of said heating mechanism on the basis of an output of said detecting device in the operation in the cleaning mode.

3. An image heating apparatus according to claim 2, wherein in the operation in the cleaning mode, said controller stops the operation of said heating mechanism after said rotatable collecting member is cleaned for a predetermined time in a state in which said urging roller is in the second position and before said urging roller is moved from the second position to the first position.

4. An image heating apparatus according to claim 1, further comprising:

a first roller about which said cleaning web is wound; and a second roller configured to wind up said cleaning web, wherein said urging roller is provided between said first and second rollers with respect to a movement direction of said cleaning web.

5. An image heating apparatus according to claim 1, wherein said rotatable collecting member is a follower roller rotated by said rotatable heating member.

6. An image heating apparatus comprising:

a rotatable heating member configured to heat a toner image on a recording material;

a rotatable collecting member configured to collect a toner deposited on said rotatable heating member;

a cleaning web configured to clean said rotatable collecting member;

an urging roller configured to urge said cleaning web toward said rotatable collecting member;

a moving mechanism configured to move said urging roller so as to be movable between a first position where said cleaning web contacts said rotatable collecting member, a second position where said cleaning web contacts said rotatable collecting member at a contact pressure lower than the contact pressure at the first position, and a third position where said cleaning web is spaced from said rotatable collecting member;

an executing portion configured to execute an operation in a cleaning mode in which said rotatable collecting member is cleaned at the second position and the first position in this order; and a controller configured to control the temperature of said rotatable collecting roller in the operation in the cleaning mode, wherein in the operation in the cleaning mode, said moving mechanism moves said urging roller from the third position to the second position when the temperature is a first temperature, and moves said urging roller from the second position to the first position when the temperature is a second temperature lower than the first temperature.

7. An image heating apparatus according to claim 6, further comprising:

a detecting device configured to detect the temperature of said rotatable collecting member; and a heating mechanism configured to heat said rotatable heating member, wherein said controller controls an operation of said heating mechanism on the basis of an output of said detecting device in the operation in the cleaning mode.

8. An image heating apparatus according to claim 7, wherein in the operation in the cleaning mode, said controller stops the operation of said heating mechanism after said rotatable collecting member is cleaned for a predetermined time in a state in which said urging roller is in the second position and before said urging roller is moved from the second position to the first position.

9. An image heating apparatus according to claim 6, further comprising:

a first roller about which said cleaning web is wound; and a second roller configured to wind up said cleaning web, wherein said urging roller is provided between said first and second rollers with respect to a movement direction of said cleaning web.

10. An image heating apparatus according to claim 6, wherein in the operation in the cleaning mode, said controller maintains the temperature of said rotatable collecting member, in a period of a lapse of a predetermined time from movement of said urging roller from the third position to the second position, and a temperature of not less than the first temperature.

11. An image heating apparatus according to claim 6, wherein in the operation in the cleaning mode, said controller maintains the temperature of said rotatable collecting member at a temperature of not more than the second temperature after said urging roller is moved from the second position to the first position.

12. An image heating apparatus according to claim 6, wherein said rotatable collecting member is a follower roller rotated by said rotatable heating member.

13. An image heating apparatus comprising:

a rotatable heating member configured to heat a toner image on a recording material;

a rotatable collecting member configured to collect a toner deposited on said rotatable heating member;

a cleaning web configured to clean said rotatable collecting member;

an urging roller configured to urge said cleaning web toward said rotatable collecting member;

a moving mechanism configured to move said urging roller so as to be movable between a first position where said cleaning web contacts said rotatable collecting member, a second position where said cleaning web contacts said rotatable collecting member at a contact pressure lower than the contact pressure at the first position, and a third position where said cleaning web is spaced from said rotatable collecting member;

an executing portion configured to execute an operation in a cleaning mode in which said rotatable collecting member is cleaned at the second position and the first position in this order; and a controller configured to move said cleaning web from the first position to the third position with the generation of a jam and configured to start a cleaning process after jam clearance by moving said cleaning web from the third position to the second position when the temperature of said rotatable collecting member is not less than a predetermined temperature.

14. An image heating apparatus according to claim 13, wherein said controller maintains the temperature of said rotatable collecting member at a temperature of not less than the predetermined temperature in a period from start of the cleaning process to a lapse of a predetermined time.

15. An image heating apparatus according to claim 14, wherein during the cleaning process, said controller moves said urging roller from the second position to the first position after the temperature of said rotatable collecting member is lowered to a temperature lower than the predetermined temperature.

16. An image heating apparatus according to claim 15, wherein during the cleaning process, said controller maintains the temperature of said rotatable collecting member at a temperature of not more than the temperature lower than the predetermined temperature after the urging roller is moved from the second position to the first position.

17. An image heating apparatus according to claim 13, further comprising:

a detecting device configured to detect the temperature of said rotatable collecting member; and a heating mechanism configured to heat said rotatable heating member, wherein said controller controls an operation of said heating mechanism on the basis of an output of said detecting device in the operation in the cleaning mode.

18. An image heating apparatus according to claim 13, further comprising:

a first roller about which said cleaning web is wound; and a second roller configured to wind up said cleaning web, wherein said urging roller is provided between said first and second rollers with respect to a movement direction of said cleaning web.

19. An image heating apparatus according to claim 13, wherein said rotatable collecting member is a follower roller rotated by said rotatable heating member.

* * * * *